US006163278A

United States Patent [19]

Janman

[11] Patent Number: 6,163,278

[45] Date of Patent: Dec. 19, 2000

[54] ELECTRONIC LOCATING SYSTEM FOR LOCATING VEHICLES AT ASSEMBLY PLANTS

[75] Inventor: David R. Janman, Warren, Mich.

[73] Assignee: DaimlerChrysler Corporation, Auburn Hills, Mich.

[21] Appl. No.: 09/188,974

[22] Filed: Nov. 10, 1998

[51] Int. Cl.[7] ..... G08G 1/123

[52] U.S. Cl. ..... 340/988; 235/384; 340/426; 340/539; 340/932.2; 701/213

[58] Field of Search ..... 340/426, 988, 340/539, 825.69, 825.72, 932.2; 307/10.1; 701/213; 235/384

[56] References Cited

U.S. PATENT DOCUMENTS

| | | | |
|---|---|---|---|
| 3,688,256 | 8/1972 | D'Ausilio et al. . | |
| 4,383,242 | 5/1983 | Sassover et al. | 340/543 |
| 4,636,950 | 1/1987 | Caswell et al. | 340/505 |
| 4,691,385 | 9/1987 | Tupman | 455/607 |
| 4,918,607 | 4/1990 | Wible | 180/169 |
| 4,990,757 | 2/1991 | Edwards et al. | 235/384 |
| 5,563,579 | 10/1996 | Carter | 340/539 |
| 5,631,642 | 5/1997 | Brockeisby et al. | 340/993 |
| 5,635,693 | 6/1997 | Benson et al. | 235/384 |
| 5,664,113 | 9/1997 | Worger et al. | 705/28 |
| 5,801,618 | 9/1998 | Jenkins | 340/937 |

*Primary Examiner*—Brent A. Swarthout
*Attorney, Agent, or Firm*—William J. Coughlin

[57] ABSTRACT

A system for electronically locating particular vehicles from within a large plurality of vehicles parked on a holding lot of an assembly plant. A control system transmits a signal encoded with a particular Vehicle Identification Number (VIN) to a plurality of signal repeaters disposed on lamp posts or other fixed items throughout the holding lot, where the lamp posts or other like items are disposed in a grid pattern or network over the holding lot. The signal repeaters transmit VIN-encoded low power radio frequency signals covering the entire holding lot. Each vehicle includes a Single Body Engine Controller (SBEC) which includes the VIN of the vehicle and a Body Control Module (BCM) in communication with its associated SBEC which is capable of activating the Vehicle Theft Alarm (VTA) of the vehicle, to thereby activate the horn and/or lights of the vehicle. The VTA includes an RF receiver associated therewith which receives the RF signal from the repeaters. The BCM checks to determine if the VIN encoded in its SBEC matches the VIN encoded in the received RF signal. If so, the BCM activates the lights and/or horn of the vehicle. Alternatively, the BCM or the VTA includes a radio frequency transceiver which transmits a location identifying signal back to one or more repeaters disposed closely adjacent the vehicle. The location identifying signal is displayed on a display system to enable the location of the vehicle to be relatively precisely determined on the holding lot.

9 Claims, 2 Drawing Sheets

FIG 2
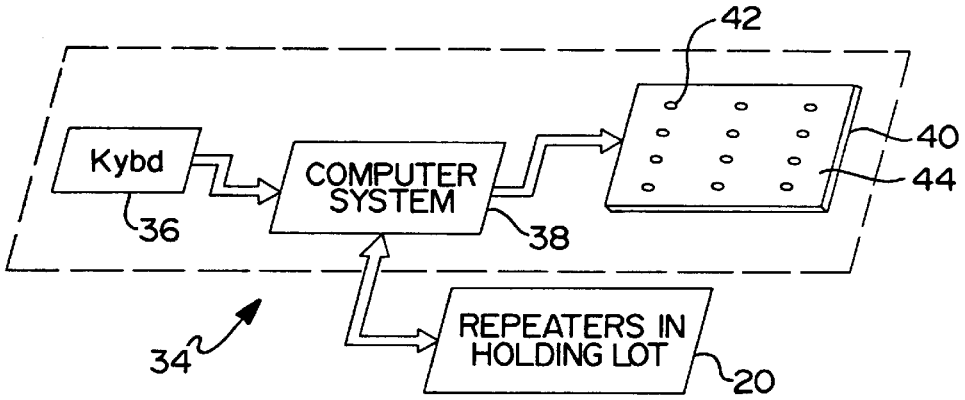
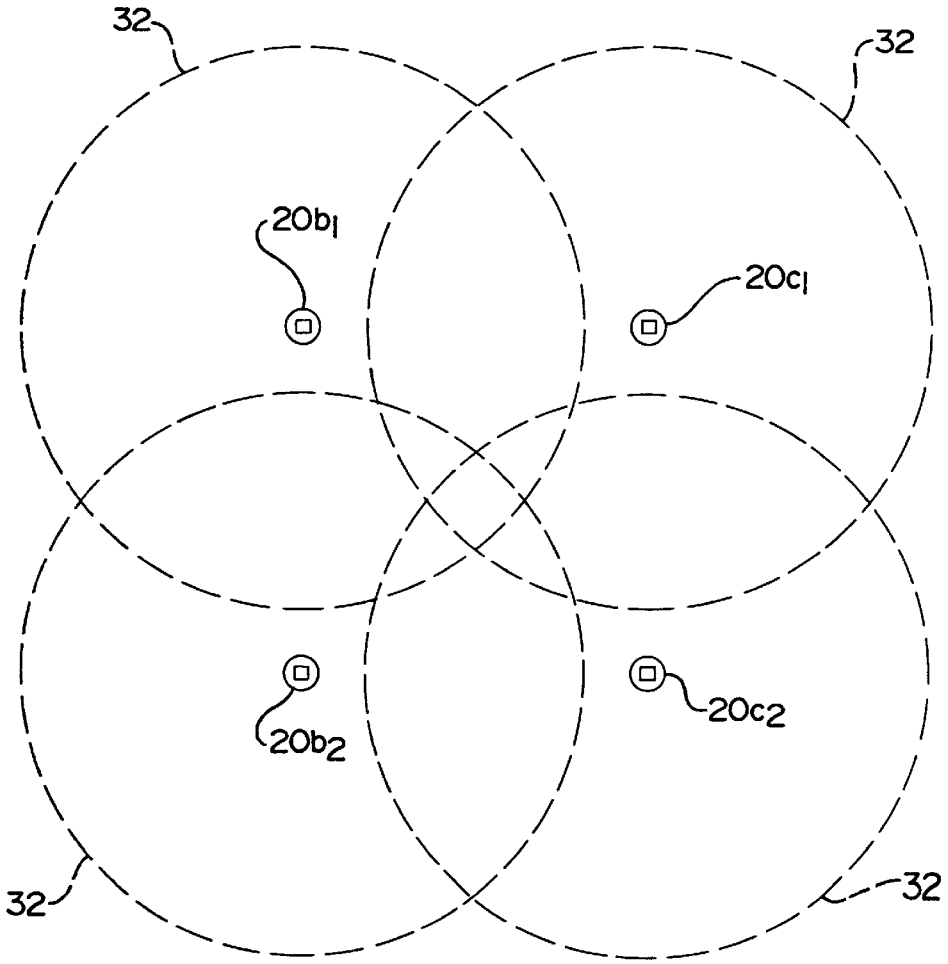
FIG 3

ELECTRONIC LOCATING SYSTEM FOR LOCATING VEHICLES AT ASSEMBLY PLANTS

BACKGROUND OF THE INVENTION

1. Technical Field

This invention is related to systems for locating specific vehicles within holding lots at motor vehicle assembly plants, and more particularly to an electronic system for quickly locating vehicles based on the vehicle identification number (VIN) of the particular vehicle to be located.

2. Discussion

Most motor vehicles such as cars and trucks are assembled in large quantities at an assembly plant having one or more holding lots. These holding lots are usually very large, often covering dozens of acres, and sometimes hundreds of acres of ground. Often, a holding lot may be large enough to hold up to 5,000 vehicles or more. They are typically used to temporarily store vehicles which require minor repairs before being shipped to a dealership for sale, or vehicles to be used internally by the vehicle manufacturer. Most holding lots also include a uniform network of lamp posts placed evenly throughout the holding lot, such as every 100 feet in a grid pattern throughout the holding lot, for illuminating the holding lot at night.

When specific vehicles need to be located, this can be a cumbersome and time consuming task. Typically, the VIN for each vehicle is given to an individual who then must go out onto the holding lot and manually check the VIN for every vehicle parked on the lot which matches the make and color of the vehicle associated with the VIN. On large holding lots, it can often take an individual 30–60 minutes just to locate a single vehicle. Accordingly, this arrangement for locating specific vehicles is extremely inefficient, labor intensive and time consuming.

It is therefore a principal object of the present invention to provide an electronic system which enables vehicles to be quickly located based on the VIN assigned to each vehicle.

It is a further object of the present invention to provide an electronic system for locating particular vehicles from within a large number of vehicles parked on the holding lot of a motor vehicle assembly plant, wherein the system does not require the use of hand-held portable transceivers or other like devices to enable personnel on the holding lot to quickly locate the particular vehicles requested.

It is still another object of the present invention to provide an electronic system for locating particular vehicles within a large number of vehicles parked on a holding lot of an assembly plant, where use is made of the lamp posts which are spaced evenly throughout the holding lot in a grid pattern, such that only a limited amount of additional structure needs to be installed on the holding lot to accomplish the task of quickly locating specific vehicles based on the VIN assigned to each vehicle parked on the holding lot.

SUMMARY OF THE INVENTION

The above and other objects are provided by an electronic system for locating vehicles parked on a holding lot at a motor vehicle assembly plant. The system of the present invention comprises a control system which is disposed preferably adjacent the holding lot or possibly even within the holding lot, or further possibly within a nearby assembly plant. The control system generally comprises a computer system which transmits a signal encoded with the VIN of the vehicle to be located to a plurality of radio frequency signal transmitters (i.e., repeaters). The repeaters are mounted on the lamp posts within the holding lot in accordance with the grid pattern or network formed by the lamp posts. Thus, when installed, the repeaters form a grid network capable of emitting low power radio frequency signals over the entire holding lot.

The present invention further makes use of the Single Board Engine Controller (SBEC) and a Body Control Module (BCM) associated with each motor vehicle parked on the holding lot. The SBEC is a control module which has the vehicle identification number (VIN) encoded into a memory circuit therewithin. The BCM is a control module which contains the circuits for the vehicle theft alarm system (VTA) lights, horn and other actuating circuits. The VTA has an RF receiver for receiving RF signals transmitted in the near vicinity of the vehicle. The present invention contemplates using the RF receiver of the BCM to receive the low power radio frequency signals from the repeaters mounted on the lamp posts throughout the holding lot. The BCM is able to communicate with the SBEC to check if the VIN encoded signal it receives from the repeater(s) matches the VIN stored in the SBEC. If it does, the VTA is caused to activate the vehicle lights or vehicle horn just as if an intrusion was occurring into the vehicle when the vehicle receives an appropriate radio frequency signal from one of the repeaters.

The control system includes a keyboard or other input device which allows a user to input the VIN of the particular vehicle to be located. The computer system generates a signal encoded with information corresponding to the VIN of the vehicle to be located and transmits this signal to the repeaters on the holding lot via a hard-wired conductor network which interconnects each and every repeater with the computer system or, alternatively, via RF signals. This signal is transmitted to all of the repeaters virtually simultaneously whether same are appropriately interconnected in parallel and serial fashion or independent of each other but with RF reception capability. The VTA system of each vehicle receives the VIN encoded RF signal from one or more of the RF repeaters. The BCM of the vehicle having the VIN which matches the VIN encoded repeater signal is then detected. The VTA then causes the vehicle's lights and/or horn to be activated, which allows the vehicle to be quickly located in either day or night time conditions.

In an alternative preferred embodiment of the present invention the BCM of each vehicle is modified to include a low power radio frequency receiver and transmitter. The low power RF transceiver is programmed to transmit a location identifying signal upon receiving an RF interrogation signal from at least one of the repeaters which is encoded with the VIN matching the VIN stored in the SBEC and/or BCM of the vehicle. The location identifying signal is received by at least one closely adjacently located repeater and transmitted back to the control system. This enables an individual operating the control system to quickly determine the precise location of the vehicle within the holding lot. It will be appreciated, then, that this preferred embodiment does not require activation of the vehicle's lights or horn. Rather, a display system having a plurality of light emitting diodes (LEDs) arranged in a grid pattern corresponding to the grid pattern of the repeaters in the holding lot is used to provide an indication of the relative position of the desired vehicle within the holding lot. The precise location of the vehicle is then relayed to personnel on the holding lot by other means such as by telephone or hand held transceivers.

The various preferred embodiments described herein enable particular vehicles to be quickly located from hundreds or even thousands of vehicles on a large holding lot of an assembly plant. The present invention significantly reduces the man hours needed to locate particular vehicles from hundreds or thousands of vehicles on an assembly plant holding lot, and therefore represents very significant savings in man hours needed to accomplish this task.

BRIEF DESCRIPTION OF THE DRAWINGS

FIG. 2 is a simplified block diagram of an alternative preferred embodiment of the present invention in which two way communication occurs between the repeaters and the control system such that information is provided to a display system to enable an individual to quickly determine the precise location of a vehicle within a holding lot; and FIG. 3 is an enlarged view of a portion of the holding lot shown in FIG. 1 illustrating the overlap of RF signals generated by each repeater.

DETAILED DESCRIPTION OF THE PREFERRED EMBODIMENT

Figure 1:
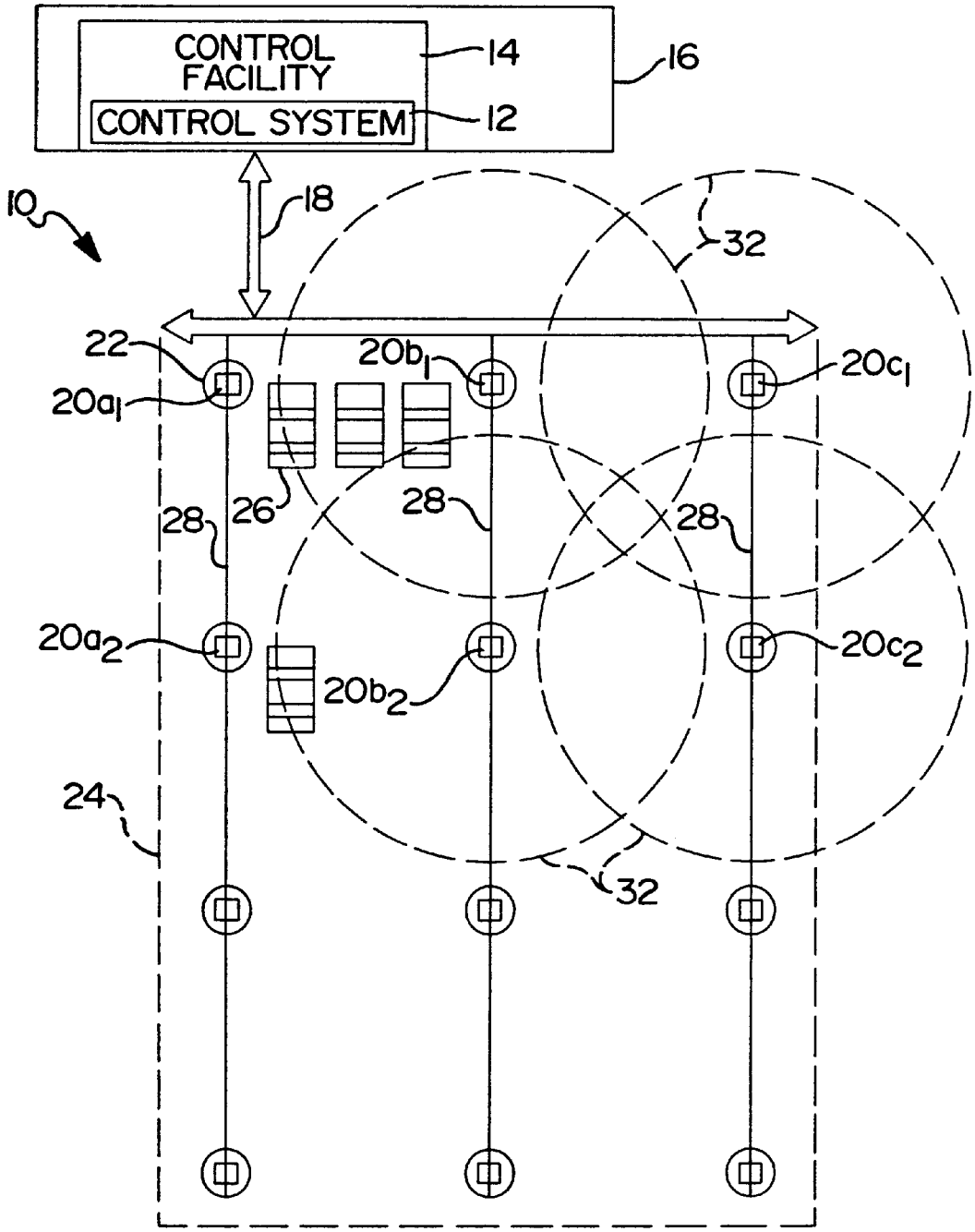
FIG. 1 is a simplified schematic block diagram drawing of a control facility having a control system of the present invention disposed therein, together with a simplified representation of the grid network of repeaters disposed throughout a holding lot and the communication lines between the control system and the repeaters.

Referring to FIG. 1, there is shown an electronic vehicle locating system 10 in accordance with the present invention. The locating system 10 generally includes a control system 12 disposed within a control facility 14. The control facility typically is manned by one or more individuals and may be within an assembly plant 16 or remote from the assembly plant 16 where motor vehicles are assembled. The control system 12 comprises a computer system having a transmitter which transmits a signal, either via hard-wired electrical conductors, represented by bus 18, or a radio frequency signal, to a plurality of repeaters 20. Each of the repeaters 20 are disposed on an associated lamp post 22 or other like structure positioned throughout a holding lot 24 on which a large plurality of vehicles 26 are parked. The lamp posts 22, and thus the repeaters 20, are laid out in an X and Y grid network fashion on the holding lot 24. If hard-wired, the repeaters 20 will be interconnected by suitable electrical conductors 28. If the repeaters 22 are to be actuated by radio frequency signals, then bus 18 and conductors 28 are not needed. In this instance, each repeater 20 comprises a low power, radio frequency transmitter or transceiver capable of transmitting a radio frequency signal which it receives over a limited area in a generally circumferential pattern around its associated lamp post 22. It will be appreciated that the strength of the signal required to be generated by the repeaters 20 will depend on the distance between adjacently positioned repeaters 20. Typically, such a distance will range within about 50–200 feet. Accordingly, only a very low power signal needs to be generated by each repeater 20 to cover an area surrounding its associated lamp post 22, where the area to be covered is only typically about 100–400 feet in diameter. Such a signal typically only needs to be on the order of 0.1 watt or even less.

At the control facility an individual inputs the vehicle identification number (VIN) into the control system 12 for each vehicle that needs to be located on the holding lot 24. The control system 12 generates a signal over bus 18, or by radio frequency means, to each of the repeaters 20 on the holding lot 24. If all of the repeaters 20 are wired together in serial and parallel fashion, then each of the repeaters 20 will generally simultaneously radiate a low power radio frequency signal therefrom. The area preferably covered by this signal is shown in dashed lines and indicated by reference numeral 32. In FIG. 3, the overlap of the area of coverage of each signal is shown in enlarged fashion to even better illustrate that no "dead spots" exist between any four adjacently positioned repeaters at which the RF signal would not be present. Accordingly, the entire holding lot 24 will be subjected to (i.e., "blanketed by") the low power RF signals generated by the repeaters 20, which signals are encoded with the particular VIN of the vehicle to be located.

The present invention also makes use of the Single Board Engine Controller (SBEC) which is associated with each vehicle 26, and also with the Body Control Module (BCM) which is also associated with each vehicle 26. The BCM includes the Vehicle Theft Alarm (VTA) circuits which activate the vehicle's horn and/or lights when an intrusion of the vehicle is sensed. The BCM of each vehicle includes a radio frequency receiver or, alternatively, a radio frequency transceiver, which is operable to receive the radio frequency signals generated by repeaters 20. The SBEC includes a memory circuit in which the VIN of the vehicle is stored. The SBEC is wired for communication with the BCM during manufacture of the vehicle such that the BCM initially is capable of checking the VIN stored in the SBEC and then storing the VIN in a memory of the BCM. In this manner the VTA is able to make the comparison of the VIN when it receives the VIN encoded RF signal.

For the purpose of the prevention invention, the VTA of the BCM is pre-programmed to activate the vehicle's lights and/or horn whenever a check of the VIN stored in the BCM indicates a match with the VIN-encoded RF signal. The activation of the vehicle's lights and/or horn can be sustained either for a predetermined time, by appropriate programming of the BCM, or as long as the BCM is receiving the VIN-encoded RF signal from one or more of the repeaters 20. In either event, the activation of the lights and/or horn should be sufficient in duration, preferably between 1–5 minutes, to enable the vehicle to be quickly located from among the large plurality of vehicles on the holding lot 24. In this manner, location of any particular vehicle on holding lot 24 is made possible with only minimal modifications to the modules installed on each vehicle 26.

Referring now to FIG. 2, an alternative preferred embodiment 34 of the control system of the present invention is illustrated. This embodiment makes use of a keyboard 36, a computer system 38 and a display system 40, which collectively form the control system 34. The keyboard 36 and computer system 38 are also preferably included in the control system 12, but the display system 40 enables an individual at the control facility 14 to quickly visually identify the precise location of any particular vehicle 26 on the holding lot 24. This is accomplished by the use of a display system 40 having a plurality of display elements 42 such as light emitting diodes (LEDs). The LEDs 42 are arranged on a display panel 44 of the display system 40 in a grid pattern corresponding to the grid pattern of the repeaters 20 on the holding lot 24. In this embodiment each repeater 20 comprises a low power radio frequency transceiver. Each repeater 20 further corresponds to a single LED 42 on the display panel 44.

When an individual inputs a particular VIN of a vehicle at the keyboard 36, the computer system 38 generates an encoded signal corresponding to the desired VIN. This encoded signal is transmitted to each repeater in the holding lot 24. Again, this may be accomplished via hard-wired conductors between the computer system 38 and each repeater 20 or by a transmitter having sufficient strength to transmit the VIN-encoded signal by radio frequency waves to each repeater 20 on the lot. In either event, each repeater 20 receives the VIN-encoded signal and generates an omnidirectional, VIN-encoded interrogation signal which is received by the BCM of each vehicle 26 parked within reception range of any particular repeater 20. Only a vehicle having an SBEC encoded with the VIN matching the VIN-encoded signal responds, however, by its BCM generating a location identifying signal back to one or more of the repeaters 20. In this regard it will be appreciated that the location identifying signal transmitted by the BCM is a very low power signal but still is powerful enough to reach and be received by at least one, and typically two or more, of the repeaters 20. The repeaters 20 receiving the location identifying signal transmit same back to the computer system 38, which causes corresponding ones of the LEDs 42 to be illuminated on the display system 40. Thus, the individual monitoring the display system 40 can quickly determine with relative precision the location of the vehicle to be located.

In the embodiment of FIG. 2, it is also preferred that each lamp post 22 be marked with an identifier such as an alpha numeric designation (e.g., a1, b1, c2, etc.). The display elements 42 are also preferably marked in accordance with their corresponding repeater positions such that the individual at the control facility 14 can quickly relay information to personnel on the holding lot 24 as to the approximate position of the responding vehicle 26 on the holding lot 24 by referencing the specific lamp post designators near the vehicle in question. The relaying of this information may be accomplished by telephone, low power handheld transceivers, etc.

In view of the foregoing, it will be appreciated that the various preferred embodiments described herein all enable a particular vehicle to be quickly located from hundreds or thousands of vehicles on a large holding lot. This is accomplished with only limited modification of the BCM module located on each vehicle. The present invention further enables particular vehicles to be located based on the VIN assigned to the vehicle either during day time or night time conditions, or in adverse weather conditions involving fog or other conditions where visibility may be limited. The system described herein can easily be implemented on more than one holding lot, if more than one independent lot is located near or adjacent an assembly plant. The apparatus and method of the present invention thus represents a significant savings in man hours which are typically needed to locate particular vehicles on a holding lot.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A system for locating particular vehicles on a holding lot having a large plurality of vehicles parked thereon, wherein each said vehicle is equipped with a single board engine controller (SBEC), the SBEC containing a code corresponding to the vehicle's Vehicle Identification Number (VIN), and the vehicle further having a Body Control Module (BCM) having a Vehicle Theft Alarm (VTA) system for activating at least one of the vehicle's lights or horn, the VTA having a radio frequency receiver associated therewith, the system comprising:

a control system for transmitting a locating signal encoded with a particular VIN of a vehicle located on said holding lot, said control system including a computer system for enabling an individual to enter a particular VIN associated with a particular vehicle;

a plurality of radio frequency signal repeaters arranged in a grid network on said holding lot and responsive to said locating signal, said signal repeaters each operating to transmit a low power radio frequency signal encoded with said particular VIN;

a display system operably associated with said control system which includes a display corresponding to said grid network;

wherein said SBEC of said vehicle having said particular VIN causes said VTA of said same vehicle to generate a radio frequency location identifying reply signal upon receipt of said low power radio frequency locating signal, back to one of said repeaters in proximity to said vehicle having said particular VIN; and wherein said repeater relays said location identifying signal back to said display system to enable an individual to determine a location of said vehicle having said particular VIN on said holding lot.

2. The system of claim 1, wherein said repeater comprises a radio frequency transceiver.

3. The system of claim 2, wherein said VTA operates to activate at least one of a horn or a head lamp of said vehicle when said particular VIN matches said VIN encoded in its associated SBEC.

4. The system of claim 1, wherein said repeaters are supported from lamp posts within said holding lot, said lamp posts being disposed in accordance with an X and a Y grid pattern to form said grid network.

5. The system of claim 2, wherein said control system comprises a display system having a plurality of display elements, each one of said display elements corresponding to an associated one of said repeaters and further being arranged in a grid in accordance with said grid network of said repeaters such that said display elements provide an instant visual representation of the location of said vehicle having said particular VIN relative to said holding lot.

6. A system for locating vehicles on a holding lot, wherein each said vehicle is equipped with a single board engine controller (SBEC) and a body control module (BCM) having a Vehicle Theft Alarm (VTA) for activating at least one of the vehicle's light or horn, the SBEC being encoded with a code corresponding to the vehicle's vehicle Identification Number (VIN), the system comprising:

a radio frequency receiver associated with each VTA of each vehicle;

a control system for transmitting a locating signal corresponding to a particular VIN of a vehicle located on said holding lot, said control system including a computer system for enabling an individual to enter a particular VIN associated with a particular vehicle;

a plurality of signal repeaters each responsive to said locating signal, said signal repeaters each operating to transmit a low power radio frequency signal encoded with said particular VIN in response to receipt of said locating signal to produce a plurality of overlapping areas of signal coverage to completely cover said holding lot with said VIN encoded radio frequency locating signal such that no areas on said holding lot exist that are not covered by said VIN encoded radio frequency signal;

each of said signal repeaters being supported on a corresponding lamp post disposed within said holding lot, said lamp posts being arranged in an X and Y grid pattern within said holding lot;

wherein each said VTA of each said vehicle receives said radio frequency signal and said BCM of said vehicle recognizing said particular VIN causes its associated said VTA to activate at least one of said vehicle lights or horn to assist in locating said vehicle having said particular VIN;

wherein each said signal repeater comprises a radio frequency transceiver, and wherein each said BCM is operable to transmit a location identifying signal back to at least one of said repeaters disposed in proximity to said vehicle;

wherein said control system comprises a display responsive to said location identifying signal for displaying the location of said vehicle having said particular VIN to an individual operating said control system;

wherein said display comprises a plurality of display elements arranged in accordance with the grid arrangement of said repeaters within said holding lot, each said display element corresponding to an associated one of said repeaters, to provide an instant visual representation when illuminated of where said vehicle having said particular VIN is located within said holding lot.

7. The system of claim 6, wherein each said repeater is hard-wired to said control system.

8. The system of claim 6, where each said display element comprises a light emitting diode (LED).

9. A system for locating vehicles on a holding lot, wherein each said vehicle is equipped with a single board engine controller (SBEC), a body control module (BCM) and a Vehicle Theft Alarm (VTA) system in communication with said SBEC, the SBEC containing a code corresponding to the vehicle's vehicle identification number (VIN) and the BCM containing electronic circuitry for receiving an RF signal and for transmitting a location identifying reply signal, the system comprising:

a radio frequency transceiver associated with each VTA of each vehicle;

a control system for transmitting a locating signal corresponding to a particular VIN of a vehicle located on said holding lot, said control system including a computer system for enabling an individual to enter a particular VIN associated with a particular vehicle;

a plurality of signal repeaters each responsive to said locating signal, said signal repeaters each operating to transmit a low power radio frequency signal encoded with said particular VIN in response to receipt of said locating signal;

each of said signal repeaters being supported on a corresponding lamp post disposed within said holding lot, said lamp posts being arranged in an X and a Y grid pattern within said holding lot;

a display system associated with said control system, said display system including a plurality of display elements arranged in an X and a Y grid pattern in accordance with said grid pattern of said repeaters, said display system being responsive to a location identifying signal transmitted by at least one of said repeaters;

wherein said BCM of said vehicle recognizing said particular VIN encoded in its BCM generates a location identifying reply signal upon receipt of said low power radio frequency signal from one of said repeaters, after determining that its associated SBEC is encoded with said particular VIN; and wherein said reply signal is received by at least one of said repeaters in proximity to said vehicle having said particular VIN, said one repeater operating to transmit said location identifying reply signal to said display system to cause at least one of said display elements to be activated to provide a visual representation of the approximate location of said vehicle having said particular VIN within said holding lot, to thereby assist in quickly locating said vehicle.

* * * * *